US011738360B2

(12) United States Patent
Sillince

(10) Patent No.: US 11,738,360 B2
(45) Date of Patent: Aug. 29, 2023

(54) SPRAY CAP FOR SPRAY CONTAINER

(71) Applicant: INNOVATION JUNCTION LIMITED, Chesire (GB)

(72) Inventor: Mark Sillince, West Sussex (GB)

(73) Assignee: INNOVATION JUNCTION LIMITED, Cheshire (GB)

( * ) Notice: Subject to any disclaimer, the term of this patent is extended or adjusted under 35 U.S.C. 154(b) by 421 days.

(21) Appl. No.: 16/981,446

(22) PCT Filed: Mar. 7, 2019

(86) PCT No.: PCT/EP2019/055715
§ 371 (c)(1),
(2) Date: Sep. 16, 2020

(87) PCT Pub. No.: WO2019/175016
PCT Pub. Date: Sep. 19, 2019

(65) Prior Publication Data

US 2021/0046495 A1 Feb. 18, 2021

(30) Foreign Application Priority Data

Mar. 16, 2018 (GB) ..... 1804287

(51) Int. Cl.
*B05B 11/00* (2023.01)
*B05B 11/04* (2006.01)
(Continued)

(52) U.S. Cl.
CPC ..... *B05B 11/0032* (2013.01); *B05B 1/044* (2013.01); *B05B 1/14* (2013.01);
(Continued)

(58) Field of Classification Search
CPC ..... B05B 11/0032; B05B 11/0072; B05B 11/047; B05B 1/14; B05B 1/044; B65D 47/2031
(Continued)

(56) References Cited

U.S. PATENT DOCUMENTS 3,941,149 A 3/1976 Mittleman
4,146,182 A * 3/1979 Nilson ..... B05B 11/046 239/533.13
(Continued)

FOREIGN PATENT DOCUMENTS

CN 100429441 A 4/2007
EP 2736695 A1 6/2014
(Continued)

OTHER PUBLICATIONS

Authorized Officer: Dorpema, Anne, International Search Report and Written Opinion issued in corresponding PCT application No. PCT/EP2019/055715, dated May 29, 2019, 12 pp.
(Continued)

*Primary Examiner* — Steven J Ganey
(74) *Attorney, Agent, or Firm* — KAPLAN BREYER SCHWARZ, LLP

(57) ABSTRACT

A spray cap for a spray container includes a tubular wall for connection to the spring container, a cap plate in which a plurality of spray slits is formed and a valve to admit air into the space defined by the wall but which prevents the outflow of liquid from the space to the exterior. The cap plate includes a support plate of polymeric material in which an aperture is formed. An insert of more resilient polymeric material is retained in the aperture and forms a liquid-tight seal with the support plate. The spray slits are formed in the insert. The support plate and the insert define a liquid flow path between the space and the spray slits and include
(Continued)

respective opposed annular sealing areas which are situated upstream of the spray slits and are biased into contact with one another by the resilience of the insert. When the spray cap is inverted and an increased pressure is produced in the space the pressure acts on the insert and the insert is thereby caused to deform such that the sealing areas move out of sealing contact and liquid can flow to the spray slits.

12 Claims, 5 Drawing Sheets

(51) Int. Cl.
*B65D 47/20* (2006.01)
*B05B 1/04* (2006.01)
*B05B 1/14* (2006.01)

(52) U.S. Cl.
CPC ..... *B05B 11/0072* (2013.01); *B05B 11/047* (2013.01); *B65D 47/2031* (2013.01)

(58) Field of Classification Search
USPC ... 239/104, 327, 533.1, 533.13, 533.15, 568
See application file for complete search history.

(56) References Cited

U.S. PATENT DOCUMENTS

| | | | | |
|---|---|---|---|---|
| 4,813,577 | A * | 3/1989 | Carow | B65D 47/243 239/327 |
| 7,159,798 | B2 * | 1/2007 | Carta | B05B 11/043 222/206 |
| 2012/0312895 | A1 | 12/2012 | Thurin et al. | |

FOREIGN PATENT DOCUMENTS

| | | | |
|---|---|---|---|
| WO | 2006/078370 | A1 | 7/2006 |
| WO | 2017/118854 | A1 | 7/2017 |

OTHER PUBLICATIONS

Search Report issued in corresponding British patent application No. 1804287.9, dated Sep. 13, 2018, 3 pp.
Manganna Dora Sambha, Examination Report issued in Indian Patent Application No. 202017040714 dated Mar. 14, 2022.

* cited by examiner

SPRAY CAP FOR SPRAY CONTAINER

FIELD OF THE INVENTION

The present invention relates to spray containers and, more particularly, to caps for such containers, which are commonly referred to as spray caps. Spray containers are used for dispensing a wide variety of liquids in spray or atomised form, such as deodorant, toilet cleaner, window cleaning fluid, olive oil and the like.

BACKGROUND

Spray containers typically consist of a receptacle for containing the liquid to be sprayed, connected to the upper end of which is a spray cap which includes a single spray orifice of very small diameter, typically 1 mm or less. In use, the liquid is supplied to the spray orifice under pressure and then flows through the orifice. The combination of the high pressure and the small diameter of the spray orifice results in the jet of liquid passing through the spray orifice being discharged from it in spray or atomised form. The pressurisation of the liquid supplied to the spray orifice may be effected in various ways, such as by a liquefied propellant gas contained within the receptacle, a hand-operated pump or by squeezing the wall of the receptacle, which must therefore be of flexible, resilient material. It is with this latter type of spray container that the present invention is concerned. If a pump or a propellant gas is used to generate the necessary pressure, the pressure is relatively high and the liquid is atomised, i.e. broken up into very fine droplets. If the pressure is applied by manually squeezing the wall of the receptacle, the pressure generated is relatively low and the liquid is dispensed in spray form, that is to say in the form of droplets which are significantly larger than those in an atomised spray.

In order to be able to manufacture spray caps it is generally necessary for the spray orifice to be formed in a separate nozzle component and for that component to be subsequently connected to the remainder of the spray cap, whereby conventional spray caps therefore generally include at least two components, which must be manufactured separately and then connected together. This results in a not insignificant manufacturing cost.

When a spray container of the type with which the invention is concerned is operated by squeezing the flexible container, the amount of liquid dispensed tends to be very small and it is generally necessary to squeeze the receptacle a number of times in order to dispense sufficient liquid. In order that the receptacle can return from its squeezed or deformed shape to its original, generally cylindrical, shape under the force of its own resilience it is necessary for a significant volume of air to enter the receptacle and it can generally do this only through the spray orifice. However, the very small diameter of this orifice means that this takes a considerable period of time, particularly as the sub-atmospheric pressure created in the receptacle by the resilience of its wall is very small, whereby the pressure differential which causes atmospheric air to flow into the container is very small also.

The spray issuing from a single spray orifice has a generally conical shape with the majority of the droplets being concentrated in an outer generally circular region and relatively few droplets in the area within the circular region. This means that the coverage of the sprayed liquid on a surface which is to be sprayed is very uneven and in order to obtain something approaching uniform coverage it is necessary to move the spray container from side to side or in a circular motion.

WO2017/118854A discloses a spray cap in which many of these disadvantages are overcome. The spray cap comprises a one-piece moulding of polymeric material including an upper cap plate in which a plurality of slits is formed and integral with which is a non-return valve arranged to permit air to flow through it into the spray container but to prevent the flow of air through it out of the container. If the spray container is inverted and its wall deformed inwardly by the manual application of pressure, the liquid within the container is sprayed in a series of fine relatively linear sprays through the slits. A larger and more even spray coverage is thus achieved with a minimum liquid consumption and the provision of the non-return valve ensures that the spray container can rapidly return to its undeformed shape so that a nearly continuous spray may be produced by repeated squeezing of the spray container.

However, it is found that if no pressure is applied to the container wall whilst the container is inverted, and this situation routinely arises at the end of a spraying process before the container is turned through 180° to its normal, non-operative orientation, there is a tendency for the liquid in the container to drip out through the spray slits. This is highly undesirable and renders the spray container impracticable for many applications.

SUMMARY

It is therefore the object of the invention to provide a spray container and a spray cap for such a container which has all the advantages of the spray container disclosed in WO2017/118854A but in which the disadvantage of dripping referred to above is eliminated.

According to the present invention there is provided a spray cap for a spray container, the spray cap comprising a tubular wall for connection to the spray container, a cap plate in which a plurality of spray slits is formed and means to admit air into the space defined by the tubular wall but which prevents the outflow of liquid from the said space to the exterior, characterised in that the cap plate comprises a support plate of polymeric material in which an aperture is formed and an insert of more resilient polymeric material is retained in the aperture and forms a liquid tight seal with the support plate, that the plurality of spray slits is formed in the insert, that the support plate and the insert define a liquid flow path between the said space and the plurality of flow slits and include respective opposed annular sealing areas which are situated upstream of the plurality of spray slits in the liquid flow path and which are biased into sealing contact with one another by the resilience of the insert, whereby when the spray cap is inverted and an increased pressure is produced in the said space the pressure acts on the insert and the insert is caused to deform such that the sealing areas move out of sealing contact and liquid can flow to the plurality of spray slits.

Thus the spray cap of the present invention is similar to that disclosed in the prior document referred to above but the insert and the support plate define a liquid flow path leading from the interior of the tubular wall and thus, in use, the interior of the spray container to the spray slits. The support plate and the insert afford cooperating sealing areas which are biased into sealing contact with one another by the resilience of the insert. Thus when the spray container is inverted and the pressure in the container is atmospheric the liquid flow path is sealed and no liquid can drip from the spray slits. However, if the container, which is made of resilient polymeric material, is squeezed and the pressure within it is increased to a super-atmospheric value, the increased pressure acts on the underside of the insert thereby causing the cooperating sealing areas on the insert and the support plate to move apart and the flow path to be opened. Liquid can then flow to the spray slits and be dispensed through them in the form of a series of fine linear spays. When the pressure is removed from the container wall and the pressure within the container drops to a sub-atmospheric value due to the wall of the container returning to its undeformed shape under the action of its own resilience the resilience of the insert again moves the sealing areas into sealing contact and the liquid flow path is closed so no liquid can drip or otherwise exit from the spray slits. The sub-atmospheric results in atmospheric air being drawn into the interior of the container through the means to admit air whereby the container can rapidly return to its undeformed shape.

The insert may be snap-connected to the support plate. Alternatively, it may be welded, e.g. ultrasonically welded, to the support plate. In a further alternative, the insert is integral with the support plate. Since the insert is of more resilient polymeric material than the support plate, this alternative necessitates the support plate and insert being moulded together in a known method in which the two portions of the spray cap are moulded sequentially from different materials in the same moulding process, e.g. by the known "core back" moulding process, to produce a one-piece moulding. If two incompatible materials are used they may be injected into the mould cavity at the same time using the so-called twin shot moulding method.

In one embodiment, the annular surface defining the aperture in the support plate is inclined upwardly and the outwardly and constitutes a first sealing surface and the insert includes a depending annular wall integral with a base plate, the junction of the annular wall and the base plate constituting an annular second sealing surface, the first and second sealing surfaces being normally urged into sealing contact with one another by the resilience of the insert.

In one embodiment, the means for admitting air and preventing the outflow of liquid is a valve of generally duckbill type including two valve plates which are inclined towards one another and are integral with the insert and whose ends remote from the insert are biased towards one another and are separated by a slit. Such a duckbill valve may be made by the method disclosed in EP2736695A. The two plates of the valve are biased into contact with one another by their own resilience and thus normally form a seal. When the container is inverted and its wall squeezed, the increased pressure within the container will act on the outer surfaces of the valve plates and further increase the integrity of the seal so that none of the liquid in the container can flow out through the valve. When the pressure is removed from the wall of the container a sub-atmospheric pressure is produced in the container by the resilience of its wall and the two valve plates are forced apart by the greater pressure prevailing between them and an open slit is thus formed through which air flows from the atmosphere into the container thus refilling it with air in preparation fora renewed application of pressure to the container wall.

In a further embodiment, the means for admitting air and preventing the outflow of liquid comprise a plurality of grooves formed in the sealing area on the support plate or the insert. These grooves will be very small, i.e. 0.1 mm or 0.05 mm or less wide and deep and whilst such grooves are able to permit the inflow of air they effectively block the outflow of liquid under the relatively low pressure differentials which prevail due to the surface tension of the liquid.

The spray cap preferably includes a closure cap moulded integrally with the cap plate and connected to it by an integral hinge, whereby the closure cap is movable between a closed position in which it covers the cap plate, and an open position, in which it does not. It is preferred that the insert has a recess formed in its upper surface and the closure cap has a projection formed in its underside which is received in the recess in the cap plate when the closure cap is in the closed position. It is preferred also that the outer surface of the projection and the inner surface of the recess afford a recess and a projection which cooperate to form a snap connection when the closure cap is in the closed position. The closure cap preferably includes a region on its underside which is shaped and positioned so that it comes into contact with the upper surface of the insert and urges it into firmer contact with the support plate, whereby the seal produced by the two sealing areas is further enhanced. The spray slits are preferably also made by the method disclosed in EP2736695A. It is therefore preferred that each spray slit is defined by two edges of irregular shape which substantially contact one another, at least in certain regions. It is preferred also that the width of each spray slit varies along its length between substantially 0 and 0.3 mm, preferably 0.1 mm, when relatively high viscosity liquids are to be sprayed. If lower viscosity liquids are to be sprayed the width of each slit may vary along its length between substantially 0 and 0.05 mm, preferably 0.01 mm.

It is preferred that the spray slits are arranged in a substantially circular array and that the insert is substantially circular and the spray slits extend substantially radially. It is preferred also that the insert includes an annular region which is inclined upwardly and inwardly and in which the spray slits are formed so that the spray slits produce a divergent spray pattern.

The present invention also embraces a spray container comprising an open-topped receptacle with a flexible, resilient wall and a spray cap as described above connected, e.g. snap-connected or screw-thread connected, to the top of the receptacle.

BRIEF DESCRIPTION OF THE DRAWINGS

Further features and details of the invention will be apparent from the following description of two specific embodiments which is given by way of example only with reference to the accompanying drawings, in which.

DETAILED DESCRIPTION

Figure 1:
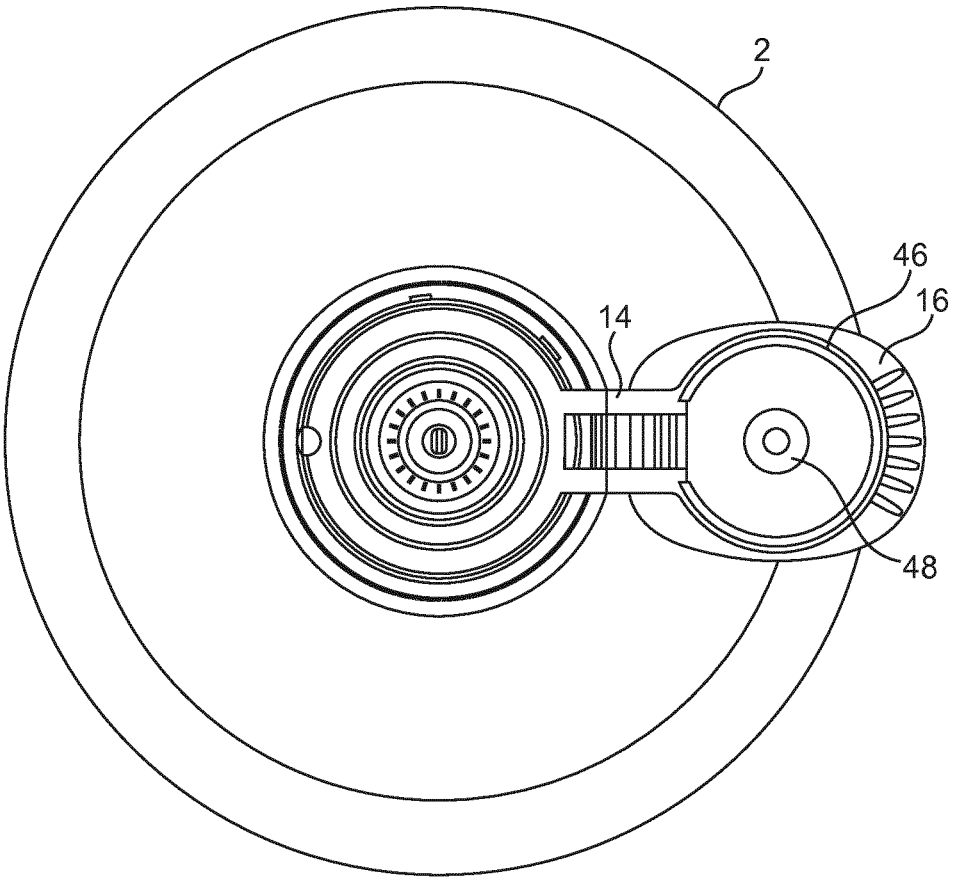
FIG. 1 is a plan view of a first embodiment of spray container in accordance with the invention showing the closure cap in the open position.
Figure 2:
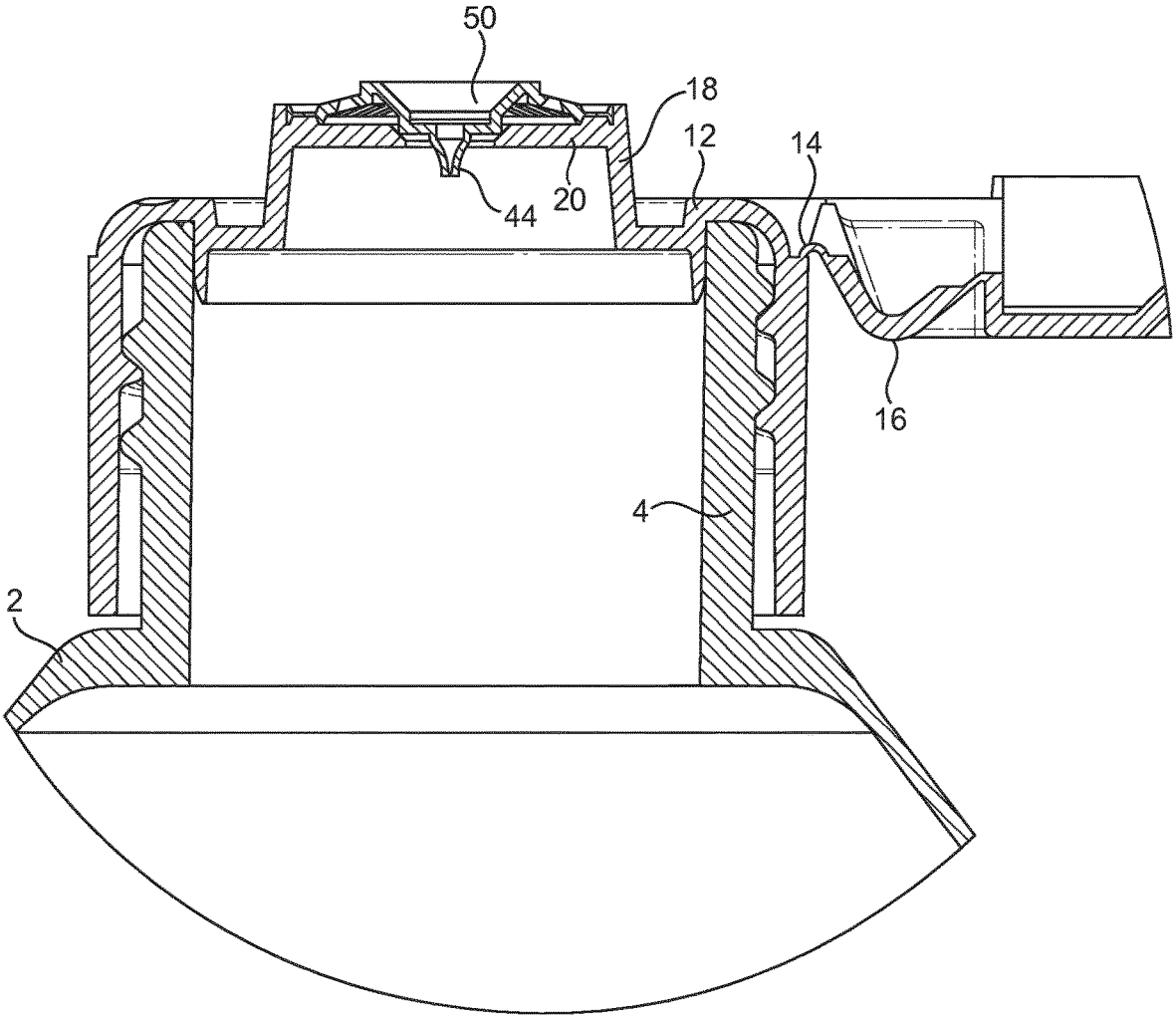
FIG. 2 is a scrap vertical sectional view through the spray container of the first embodiment showing the spray cap and only the neck and upper portion of the container and only a portion of the closure cap.
Figure 3:
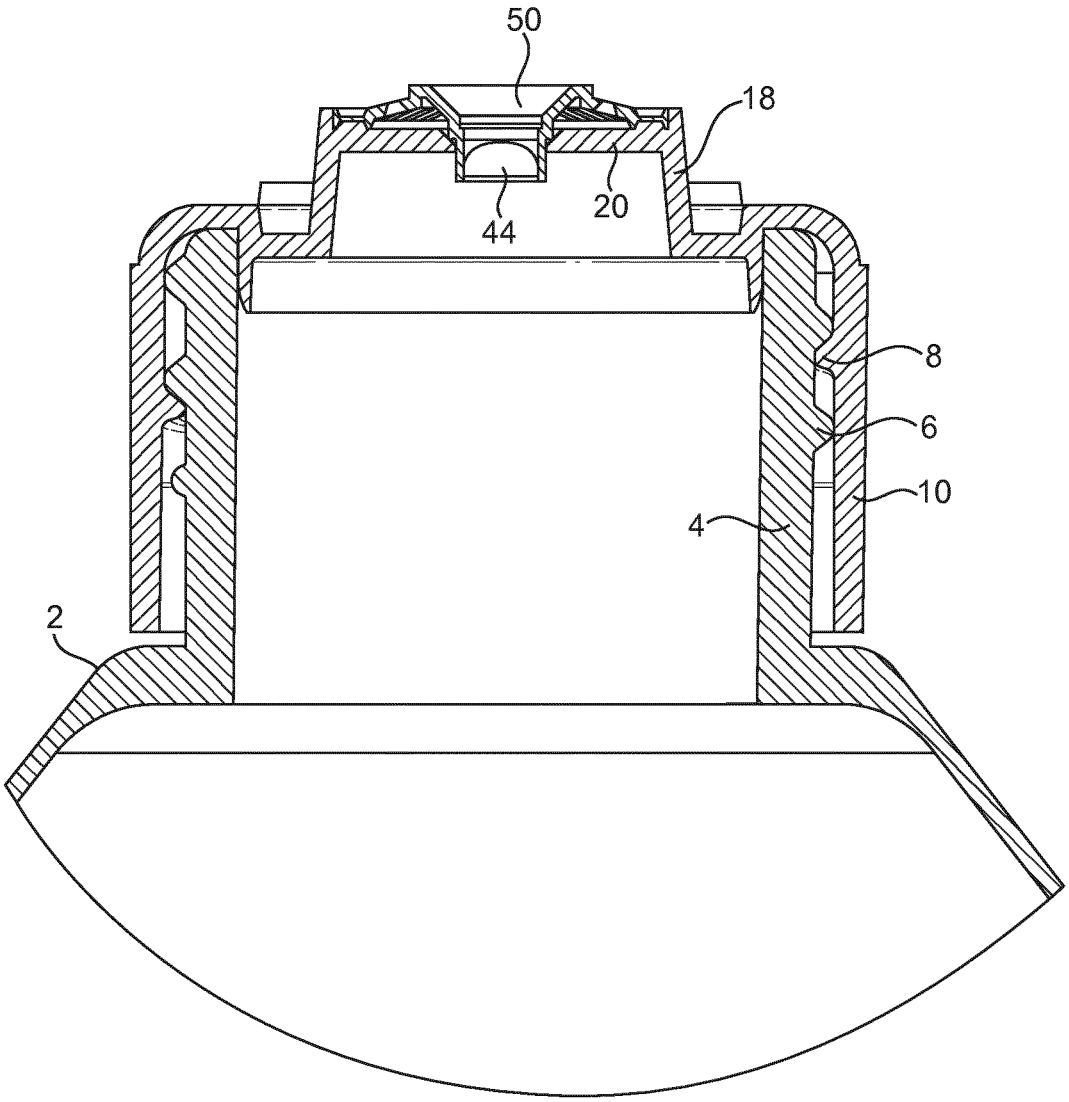
FIG. 3 is a further scrap vertical sectional view through the spray container of the first embodiment on a plane at right angles to that of FIG. 2.
Figure 4:
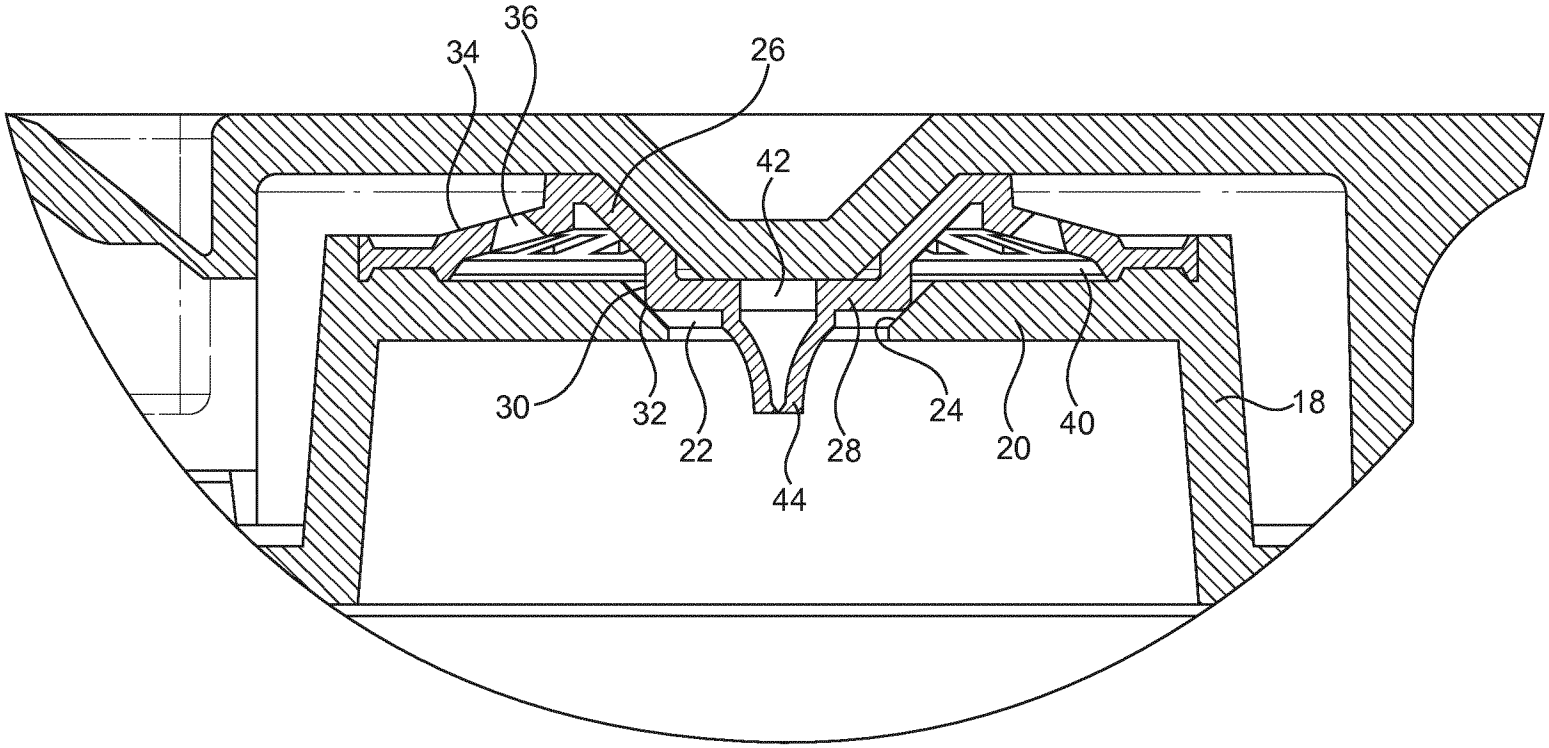
FIG. 4 is an enlarged view of a portion of the spray cap shown in FIG. 2.

Referring firstly to FIGS. 1 to 4, the spray container 2, of which only the upper portion is shown, is made of resilient polymeric material and is surmounted by an integral neck 4 of reduced diameter, formed on whose external surface is a screw thread 6. Connected to the neck 4 by means of an internal screw thread 8, cooperating with the screw thread 6, is a spray cap. The spray cap comprises a depending tubular wall 10, whose upper end is closed by an integral cap plate 12. Also integrally connected to the upper end of the wall 10 by means of an integral hinge 14 is a closure cap 16, which will be described in more detail below. Integrally upstanding from the cap plate 12 is a tubular wall 18, integrally connected to the upper edge of which is a support plate 20. Formed centrally in the circular support plate 20 is a circular aperture 22, the side surface 24 of which is inclined upwardly and outwardly and constitutes a sealing surface. Secured to the upper surface of the support plate 20, in this case by ultrasonic welding, is an insert of a polymer material which is more resilient than that of the remainder of the spray cap. In this case the insert is injection moulded from SEBS block copolymer with 10% polypropylene whilst the remainder of the spray cap is injection moulded from polypropylene. The insert is of complex shape and includes an annular plate 26 extending upwardly and outwardly. Integral with the lower end of the plate 26 is a horizontal plate 28, which extends across the aperture 22. The lower surface of the plate 28 meets a vertical surface 30, which merges with the outer surface of the plate 26 at substantially right angles. This junction 32 constitutes an annular sealing surface in contact with the sealing surface 24. Integral with the upper outer edge of the plate 26 is an annular spray plate 34, in which a plurality of equispaced, radially extending spray slits 36 is formed. The plates 26 and 34 define together with the upper surface of the support plate 20 a liquid flow passage, with which the spray slits 36 communicate. The liquid flow path extends to the interior of the container via the aperture 22 and thus between the sealing surfaces 24, 32. These sealing surfaces are normally in sealing contact with one another, such that liquid is normally unable to flow from the container to the spray slits 36. The spray plate 34 extends outwardly and downwardly so that the spray jets discharging through the slits 36 are outwardly divergent and are thus capable of covering a relatively large area. Integral with the outer edge of the spray plate 34 is a fastening plate 38 with a shape matching that of a recess 40 in the upper surface of the support plate 20 enabling the two components to be snap connected together. The shape of the recess 40 and of the various portions of the insert are such that when connected together the central portion of the insert is urged downwardly and the sealing surface or edge 32 on the insert is urged into contact with the sealing surface 24 on the support plate 20. This sealing contact is of an annular shape and the aperture 22 is thus normally sealed. Formed in the plate 28 is an opening 42, integral with two opposed edges of which are depending valve plates 44 constituting a duckbill valve. The side edges of the valve plates 44 are integrally connected together and their distal ends define a slit. The valve plates 44 are moulded such that their distal ends are normally biased into contact with one another and thus form a seal. The insert is moulded by the method disclosed in EP2736695A using a moulding tool in which one tool portion carries a large projection to form the duckbill valve and the slit between the valve plates and further smaller projections to form the spray slits.

The closure cap 16 carries an annular wall 46 on its underside, the internal diameter of which is substantially the same as the external diameter of the wall 10 of the spray cap. At the centre of the circular space defined by the wall 46 and integral with the underside of the cap 46 is a frustoconical projection 48, whose shape and size match the recess 50 defined by the inclined wall 26 of the insert. When the cap 16 is pivoted into the closed position the projection 48 is received snugly in the recess 50 and its end surface engages the upper surface of the plate 28 and urges it downwardly, thereby increasing the contact pressure between the sealing surfaces 24, 32 and thus enhancing the integrity of the seal.

In use, the sealing surfaces 24, 30 are normally urged into sealing contact with one another by the elasticity of the insert, whereby the liquid flow path between the interior of the container and the spray slits is interrupted. Even if the container is inverted, no liquid will reach the spray slits and thus no dripping of the liquid occurs. However, if the container is inverted and its outer wall squeezed thereby producing a super-atmospheric pressure in the container, this pressure acts on the underside of the plate 28 and the force produced is sufficient to move the insert in the axial direction and thus to move the sealing area 32 on the insert out of contact with the sealing area on the support plate 20. The liquid flow path is therefore opened and liquid flows along the annular liquid flow path to the spray slits 36 and is dispensed through the spray slits in the form of fine generally linear sprays. The increased pressure acts on the outer surfaces of the valve plates 44 and enhances the integrity of their seal so that the pressurised air in the container cannot dissipate through the duckbill valve. If the pressure on the wall of the container is removed, the super-atmospheric pressure in the container immediately subsides and the resilience of the insert immediately moves the sealing surface 32 back into sealing contact with the sealing surface 24, thereby again closing the liquid flow path so that no dripping of liquid from the spray slits can occur. The resilience of the wall of the container produces a sub-atmospheric pressure within the container and the duckbill valve therefore immediately opens and admits air into the container. The container may then be squeezed again to dispense further liquid through the spray slits, if desired.

Figure 5:
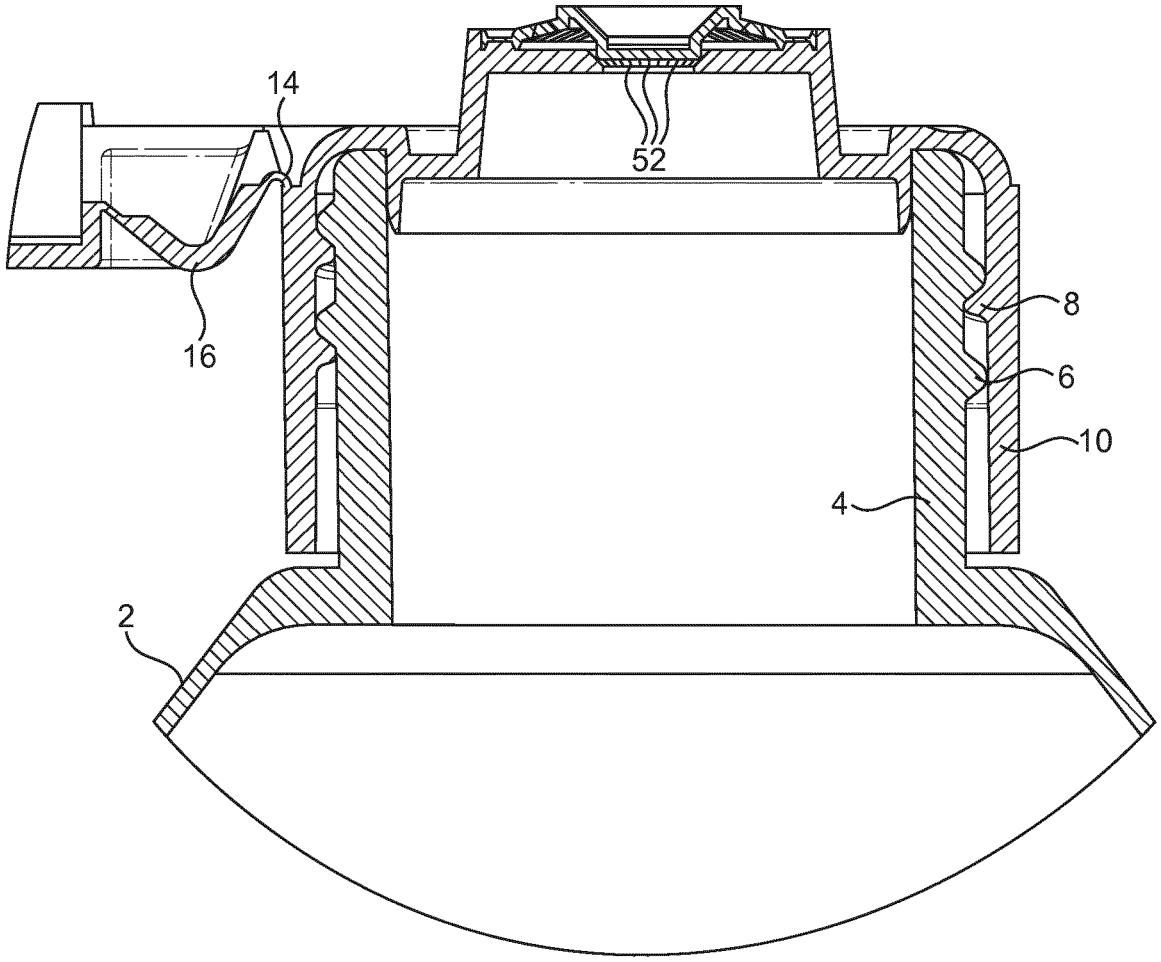
FIG. 5 is a scrap vertical sectional view similar to FIG. 3 of a second embodiment of the invention.

The second embodiment illustrated in FIG. 5 is substantially the same as the first embodiment and only the one difference will therefore be described. In this case the duckbill valve is omitted and its function is fulfilled by the provision of a plurality of bypass grooves 52 in one of the sealing surfaces, in this case the surface 24 on the support plate. These grooves are very small, typically 0.1 mm or less wide and deep. These grooves are sufficiently large to permit air to enter the container relatively rapidly when a sub-atmospheric pressure prevails within the container. However, the grooves are also sufficiently small that they effectively constitute a seal to liquid due to surface tension effects. Thus when the container is inverted and squeezed the operation is precisely the same as in the first embodiment and when the pressure on the container is removed no liquid can flow through the grooves due to surface tension and due also to the fact that air is being drawn through the grooves from the atmosphere into the container.

The invention claimed is:

1. A spray cap for a spray container, the spray cap comprising a tubular wall for connection to the spray container, a cap plate in which a plurality of spray slits is formed and means for admitting air into a space defined by the tubular wall but which prevents the outflow of liquid from the said space to the exterior, characterised in that the cap plate comprises a support plate of polymeric material in which an aperture is formed and an insert of more resilient polymeric material than the support plate is retained in the aperture and forms a liquid tight seal with the support plate, that the plurality of spray slits is formed in the insert, that the support plate and the insert define a liquid flow path between the said space and the plurality of spray slits and include respective opposed annular sealing areas which are situated upstream of the plurality of spray slits in the liquid flow path and which are biased into sealing contact with one another by the resilience of the insert, whereby when the spray cap is inverted and an increased pressure is produced in the said space the pressure acts on the insert and the insert is caused to deform such that the sealing areas move out of sealing contact and liquid can flow to the plurality of spray slits.

2. A spray cap as claimed in claim 1 in which the insert is snap connected to the support plate.

3. A spray cap as claimed in claim 1 in which the insert is integral with the support plate.

4. A spray cap as claimed in claim 1 in which the insert is welded to the support plate.

5. A spray cap as claimed in claim 1 in which the support plate and the tubular wall are integral and made of the polymeric material comprising polypropylene and the polymeric material of the insert comprises SEBS block copolymer.

6. A spray cap as claimed in claim 5, wherein the SEBS block copolymer comprises an amount of polypropylene.

7. A spray cap as claimed in claim 1 in which the annular surface defining the aperture in the support plate is inclined upwardly and outwardly and constitutes a first sealing surface and the insert includes a depending annular wall integral with a base plate, the junction of the annular wall and the base plate constituting an annular second sealing surface, the first and second sealing surfaces being normally biased into sealing contact with one another by the resilience of the insert.

8. A spray cap as claimed in claim 1 in which the means for admitting air and preventing the outflow of liquid is a valve of generally duckbill type including two valve plates which are inclined towards one another and are integral with the insert and whose ends remote from the insert are biased towards one another and are separated by a slit.

9. A spray cap as claimed in claim 1 in which the means for admitting air and preventing the outflow of liquid comprise a plurality of grooves formed in the sealing area on the support plate or the insert.

10. A spray cap as claimed in claim 1 including a closure cap moulded integrally with the cap plate and connected to it by an integral hinge, whereby the closure cap is movable between a closed position in which it covers the cap plate and an open position in which it does not.

11. A spray cap as claimed in claim 10 in which the insert has a recess formed in its upper surface and the closure cap has a projection formed in its underside which is received in the recess in the cap plate when the closure cap is in the closed position, wherein when the closure cap is in the closed position it engages the insert, thereby increasing the contact pressure of the two sealing areas.

12. A spray container including an open-topped receptacle with a flexible, resilient wall and a spray cap as claimed in claim 1 connected to the top of the receptacle.

* * * * *